US011583972B2

(12) United States Patent
Rus et al.

(10) Patent No.: US 11,583,972 B2
(45) Date of Patent: Feb. 21, 2023

(54) VIBRATION ABSORBER FOR POWER TOOLS

(71) Applicant: Massachusetts Institute of Technology, Cambridge, MA (US)

(72) Inventors: Daniela L. Rus, Weston, MA (US); Jeffrey Lipton, Medford, MA (US); Lillian Chin, Decatur, GA (US)

(73) Assignee: MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 359 days.

(21) Appl. No.: 16/851,315

(22) Filed: Apr. 17, 2020

(65) Prior Publication Data

US 2020/0331111 A1 Oct. 22, 2020

Related U.S. Application Data

(60) Provisional application No. 62/835,704, filed on Apr. 18, 2019, provisional application No. 62/835,262, filed on Apr. 17, 2019.

(51) Int. Cl.
*B24B 23/00* (2006.01)
*B24B 23/02* (2006.01)

(52) U.S. Cl.
CPC ..... *B24B 23/005* (2013.01); *B24B 23/02* (2013.01)

(58) Field of Classification Search
CPC ..... B24B 23/005; B24B 23/02; B25D 17/24
See application file for complete search history.

(56) References Cited

U.S. PATENT DOCUMENTS 4,044,625 A * 8/1977 D'Haem ..... G05G 1/06 16/431
4,592,170 A 6/1986 Hutchins et al.
4,879,847 A * 11/1989 Butzen ..... B24B 23/00 181/207
5,976,571 A * 11/1999 Crison ..... A61K 9/0004 424/464
6,161,256 A * 12/2000 Quiring ..... B25F 5/006 81/436
6,610,963 B2 * 8/2003 Zamuner ..... B23K 9/32 219/136
7,318,768 B2 * 1/2008 Deshpande ..... B24B 23/03 451/357

(Continued)

FOREIGN PATENT DOCUMENTS

EP 1 612 002 A1 1/2006

OTHER PUBLICATIONS

Search Report dated Jun. 22, 2020 for International Application No. PCT/US2020/028647; 4 Pages.

(Continued)

*Primary Examiner* — Eyamindae C Jallow
(74) *Attorney, Agent, or Firm* — Daly, Crowley, Mofford & Durkee, LLP

(57) ABSTRACT

Methods and apparatus for a vibration dampening system having an adaptor with a user contact surface and a power tool contact surface. The adaptor can include a core to reduce vibration transfer from the tool to the hands of a user. In embodiments, the core comprises a viscoelastic material that lightens a base elastomer to form liquid-filled closed cells structures.

23 Claims, 8 Drawing Sheets

(56) References Cited

U.S. PATENT DOCUMENTS

| | | | | |
|---|---|---|---|---|
| 7,703,547 | B2 * | 4/2010 | Manacorda | B25F 5/006 16/431 |
| 7,703,816 | B2 * | 4/2010 | Kitayama | E05C 17/203 16/86 A |
| 2003/0130369 | A1 * | 7/2003 | Wright | C08F 2/48 522/182 |
| 2003/0172498 | A1 | 9/2003 | Polzin et al. | |
| 2004/0078936 | A1 | 4/2004 | Walker et al. | |
| 2006/0275089 | A1 | 12/2006 | Dineen | |
| 2009/0044475 | A1 | 2/2009 | Ghosh | |
| 2012/0241637 | A1 * | 9/2012 | Simonetti | C09K 11/628 250/390.11 |
| 2014/0298574 | A1 * | 10/2014 | Williams | A63B 71/12 428/218 |
| 2015/0151422 | A1 * | 6/2015 | Kuehne | B24B 55/10 451/344 |
| 2015/0266179 | A1 * | 9/2015 | Rompel | B25F 5/02 173/48 |

OTHER PUBLICATIONS

Written Opinion dated Jun. 22, 2020 for International Application No. PCT/US2020/028647; 11 Pages.

PCT International Preliminary Report of Patentability dated Oct. 28, 2021 for International Application No. PCT/US2020/028647; 7 Pages.

Communication Pursuant to Rules 161(2) and 162 EPC for European Application No. 20790452.5 dated Dec. 10, 2021; 3 pages.

Response (with amended claims) to Communication Pursuant to Rules 161(2) and 162 EPC for European Application No. 20790452.5 dated Dec. 10, 2021; Response filed on Dec. 20, 2021; 7 pages.

Extended European Examination Report dated Nov. 29, 2022 for European Application No. 20790452.5; 7 Pages.

* cited by examiner

VIBRATION ABSORBER FOR POWER TOOLS

CROSS REFERENCE TO RELATED APPLICATIONS

The present application claims the benefit of U.S. Provisional Patent Application No. 62/835,262, filed on Apr. 17, 2019, and U.S. Provisional Patent Application No. 62/835,704, filed on Apr. 18, 2019, both of which are incorporated herein by reference.

STATEMENT REGARDING FEDERALLY SPONSORED RESEARCH

Not applicable.

FIELD

This disclosure relates generally to vibration dampening systems, and more particularly, to vibration dampening for power tools.

BACKGROUND

As is known in the art, Hand Arm Vibration Syndrome (HAVS) is an important but difficult to prevent work related injury. According to the Medical research Council, about 300K employees in the UK need protection from such vibrations. In the U.S., there are about 1.2 million workers in need of this protection according to The National Institute for Occupational Safety and Health. A single claim against an employer can cost upwards of seventy thousand dollars. Despite its ubiquity there are few good solutions for workers. Glove based vibration isolators tend to not work for workers. Workers often say they need to feel their tools and workpieces. As a result, they often cut off the fingertips of vibration reducing gloves. However, HAVS begins at the tip of fingers, thus, defeating the utility of vibration reducing gloves.

Making custom vibration dampers, however, is difficult. Many known dampening materials require casting and molding processes. Given the large number of different power tools, it may be prohibitively expensive to make molds for each power tool.

Furthermore, many vibration damping materials add mass to an elastomer substrate. This is not desirable in a power tool grip as adding mass means making the workers lift heavier loads.

SUMMARY

Embodiments of the concepts, systems, and techniques disclosed herein provide a device that covers a user interface portion of power tools. The device comprises a viscoelastic material that includes a base elastomer. In embodiments, the device is symmetric. In embodiments, the device may comprise liquid-filled closed cell structures. In some embodiments, the device may comprise a viscoelastic energy absorbing material (e.g., Sorbothane). It is understood that a variety of suitable viscoelastic materials which simultaneously absorb, isolate, and reduce vibrations, may be used.

In embodiments, the device comprises an adaptor or interface between a power tool and human hands that reduces the transmission of vibrations from the power tool to the hands while allowing the user to maintain a secure grip on the tool. The device may comprise one or more adaptor sections that adapt between a preexisting structure on a power tool and the desired configuration of a user's hand. In embodiments, an adaptor section may be removable and securely attachable to the power tool. The section may be removable and replaceable. Each moving part of the power tool that the workers hand contacts may have its own adaptor section so as to reduce internal stresses than can build in an adaptor section that would result from having to deform with the movements of the power tool components.

In embodiments, each adaptor section comprises a core of closed cell liquid filled foams (CCLFF), a surface configured for user contact, a surface configured for tool contact, and a connection mechanism to the power tool. The CCLFF includes a first material comprising a viscoelastic polymer and a second material comprising a liquid. In embodiments, the liquid is dispersed into the viscoelastic material. In some embodiments, a polymer comprises a UV cured acrylate and the liquid comprises polyethene glycol. The CCLF can have the relative cell size, and density of cells, spatially varied throughout the section. In embodiments, the cell size of the CCLFF is about 16 microns tall, about 40 microns wide and about 80 microns long. In some embodiments, the percentage of liquid by volume for vibration absorption is about 25%. In example embodiments, the percentage of liquid by volume for vibration absorption can range from about 0% to about 50%. At about 1 Hz, a storage modulus can vary between about 0.2 Mpa and about 1.4 Mpa and the loss modulus can vary between about Mpa 0.1 and about 1.4 Mpa by varying liquid concentrations.

In embodiments, an adaptor can include a surface layer bonded to the device which may ruggedize the adaptor section to make it more robust. To promote bonding of materials to the CCLFF, a layer of viscoelastic material with 0% liquid may be applied around the entire CCLFF in order to prevent having liquid on the surface of the CCLFF which may prevent adhesion of materials to the CCLFF. In example embodiment, a layer of the 0% liquid filled viscoelastic material from the CCLFF can surround the CCLFF. A durable rubberlike material can then be bonded to this layer. This high durability layer may comprise a synthetic rubber, such as a polyurethane. This multi-layer approach allows for a durable surface for easy cleaning and dust removal and prevents the liquid from the foam from leaking on to the user's hands or work pieces.

The surface for user contact is shaped to promote a controlled grip while maximizing the amount of CCLFF between the human hand and the power tool. As a result, there is a tradeoff between grip quality and protection. An ideal design may be custom made to the use case, user and tool. This highly customized method encourages the use of 3D printing as an economic means of production. In order to promote grip, the surface of user contact can have finger groves and/or or thumb depressions to encourage finger placement and enhance grip. The surface for user contact can be produced in batches, such as large medium and small, or users grouped together based on hand size.

The surface for tool contact provides the surface where the adaptor section meets the power tool. It can be formed from either a CCLFF, with or without additional compliant coatings, or it can be a rigid piece of plastic or metal bonded to the CCLFF and other layers. It should be surface-fitting to the power tool and allow the adaptor section to slide onto the power tool in example embodiments. The goal of the tool contact surface is to reduce the number of degrees of freedom of the adaptor section relative to a part of the power tool to one degree or less, which allows for sliding the device on and off the tool.

The connection between the adaptor section and the power tool can comprise chemical bonds and/or mechanical connections. Chemical bonds may be designed to be permanent or semi-permanent. Chemical bonds may be formed by adding a compound between the section and the power tool that chemically links to each surface. This compound can comprise a liquid, such as cyanoacrylate, epoxy, and silicones. It can be applied in tape form in the case of double-sided adhesives. In the semi-permanent case, the chemical bond can be broken mechanically or chemically without damaging the underlying power tool.

Mechanical connections can be formed in a number of ways. One method is a friction fit, when the geometry of the section is designed, and the surface of the section is selected to generate high frictional forces between the section and the power tool. An advantage of such friction fit connections is that they are relatively simple to produce. They are ideally suited for attaching over cylindrical or prismatic sections of uniform cross sections of the tool and may be made by using a compliant tool connection surface. The geometry of the tool connection surface is designed to eliminate all but one degree of freedom of the adaptor section relative to a part of the power tool. The friction between the adaptor section and the power tool eliminates the other degree of freedom.

Another method of mechanical connection includes the use of clips and interlocks that reference the underlying tool geometry to constrain the movement of the section relative to the tool. The goal of this method is to reduce the relative degrees of freedom of the section to the power tool to one or less. The result is that the section can only move in one or fewer directions relative to the power tool. When configured to have one degree of freedom, the section could slide on and off the tool and rely on friction or hand placement to hold itself still. When configured to have 0 degrees of freedom, the mechanical connection needs to be undone to allow for the section to move relative to the power tool. These mechanical connections may be formed either out of the CCLFF or a rigid plastic section. The CCLFF is used for compliant connections with the surface and surround the tool surface to reduce the degrees of freedom. Rigid sections may be used for adding clips and interlocks. The adaptor section may need to connect to a mechanical interlock piece to complete the mechanical connection.

Example embodiments of the tool adaptor reduce the peak accelerations experienced by a human at the finger and in the palm when using the power tool, as well as reduce the power spectral density of the vibrations.

In one aspect, an adaptor configured for coupling to a power tool for reducing transmission of vibrations from the power tool to hands of a user while allowing maintenance of a grip by the user, comprises: one or more adaptor sections, each adaptor section comprising: a core comprising a closed cell liquid filled foam (CCLFF); a user contact surface configured for contact by a user; a tool contact surface configured for contact with the power tool, wherein the core is disposed between the user contact surface and the tool contact surface; and a connection mechanism configured to secure the adaptor to the power tool.

An adaptor can further includes one or more of the following features: the at least one adaptor section comprises an inner surface contoured to complement a portion of an outer surface of the power tool, the at least one adaptor section comprises a depression for receiving one or more digits of a human hand, the depression is configured to receive a human thumb, the power tool comprises a sander having a vibrating surface, the CCLFF comprises a viscoelastic polymer and a liquid, the CCLFF comprises a percentage of the liquid by volume that ranges from about 0 percent to about 50 percent, the percentage of the liquid by volume is about 25 percent, the viscoelastic polymer comprises an acrylate, the acrylate is ultraviolet (UV) light cured, the liquid comprises polyethylene glycol, the CCLFF comprises a cell size of about sixteen microns tall, plus or minus 10 percent, the cell size is about 40 microns wide, plus or minus 10 percent, the cell size is about 80 microns long, plus or minus 10 percent, the CCLF has a storage modulus that can range from about 0.2 Mpa to about 1.4 Mpa at a frequency of about 1 Hz, the CCLF has a loss modulus that can vary from about 0.1 Mpa to about 1.4 Mpa, the CCLFF is at least partially coated with a sealing layer comprising a zero percent liquid layer, the CCLFF comprises a viscoelastic polymer and a liquid, and the sealing layer comprises the viscoelastic polymer, a synthetic rubber layer bonded to the sealing layer, the tool contact surface comprises a rigid material, the rigid material comprises plastic and/or metal, and/or the at least one adaptor second comprises an inner surface configured for friction fit engagement to an outer surface of the power tool.

BRIEF DESCRIPTION OF THE DRAWINGS

The concepts, structures, and techniques sought to be protected herein may be more fully understood from the following detailed description of the drawings, in which.

DETAILED DESCRIPTION

Figure 1:
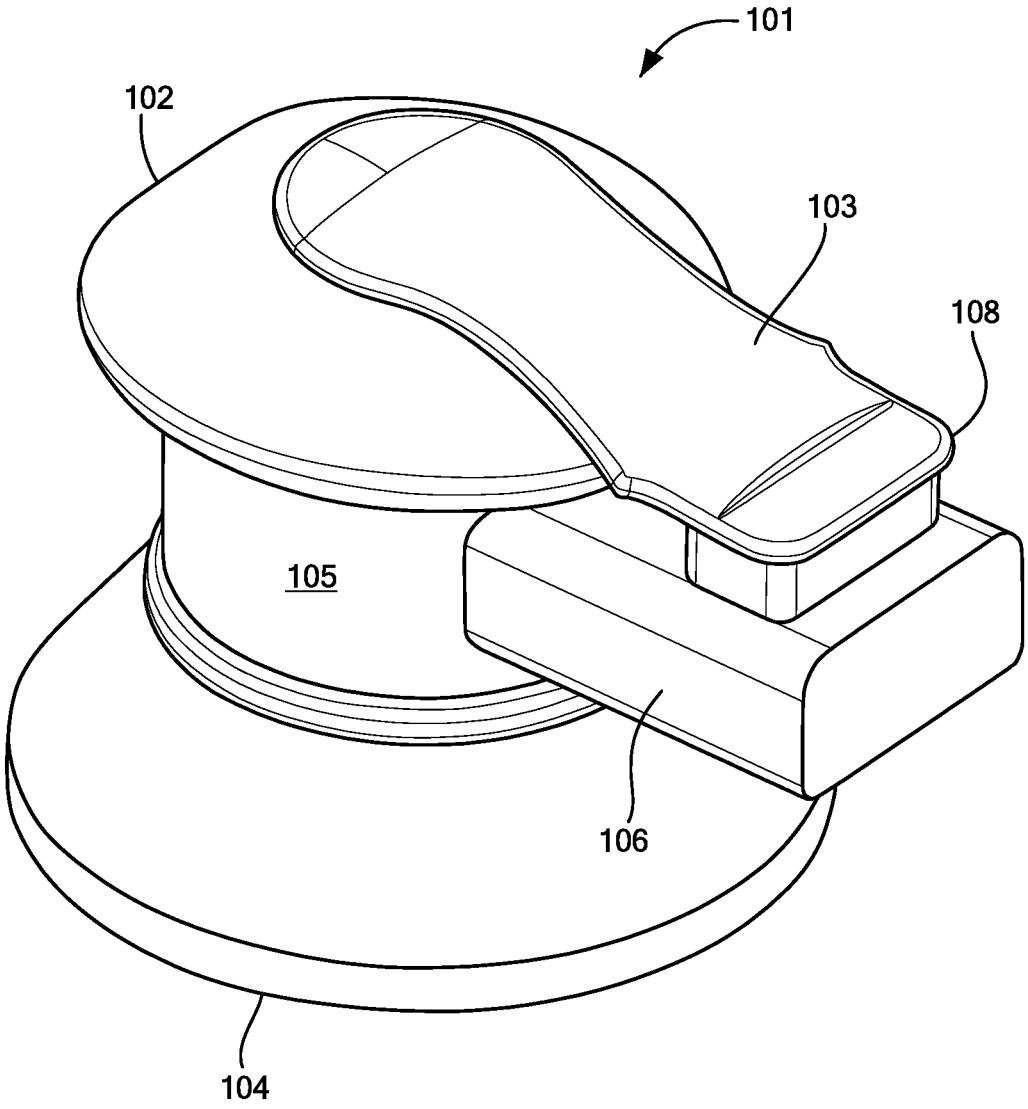
FIG. 1 PRIOR ART
FIG. 1 shows a perspective view of a prior art power tool.
Figure 1A:
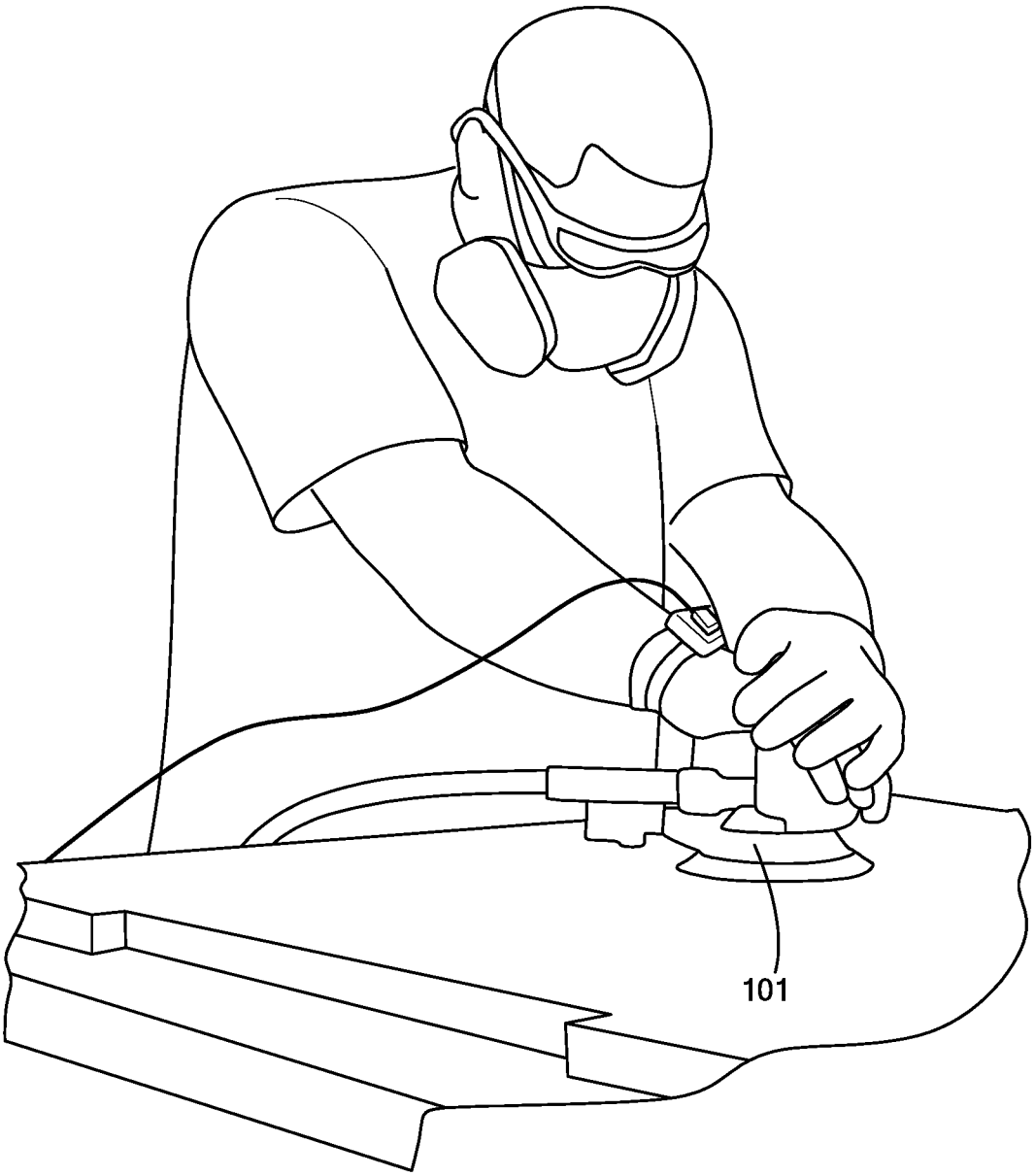
FIG. 1A is a pictorial representation of a user using the tool of FIG. 1A.

FIG. 1 shows an example prior art power tool 101 having a grip surface 102 and an upper surface 103 that moves or vibrates during operation. FIG. 1A shows an example of a user gripping the sander 101 of FIG. 1 while sanding a surface. In the illustrated embodiment, the power tool 101 comprises a sander having a vibrating surface 104 that rapidly vibrates in order to smooth a surface and/or remove material. Such vibration can transfer to a user's hands and/or palms as the user grips the power tool during use.

The illustrated power tool 101 has an annular body 105 extending up from the vibrating surface 104. A power interface 106, which may provide electrical and/or pressurized fluid connections, extends outwardly from the body 105 of the power tool. In other embodiments, a power tool may include a chamber to hold one or more batteries.

Embodiments of the invention provide methods and apparatus for an adaptor that can be attached to a vibrating power tool for reducing vibration transfer. In embodiments, the adaptor comprises a unitary body configured to attach to the body of a given power tool. In other embodiments, the adaptor comprises two or more adaptor portions for attachment to different parts of power tools. In general, it is desirable to provide an adaptor having one or more sections or portions to cover each moving part of the power tool that contacts the hands of a workers. This arrangement reduces the vibration absorbed by the user's hands.

Figure 2:
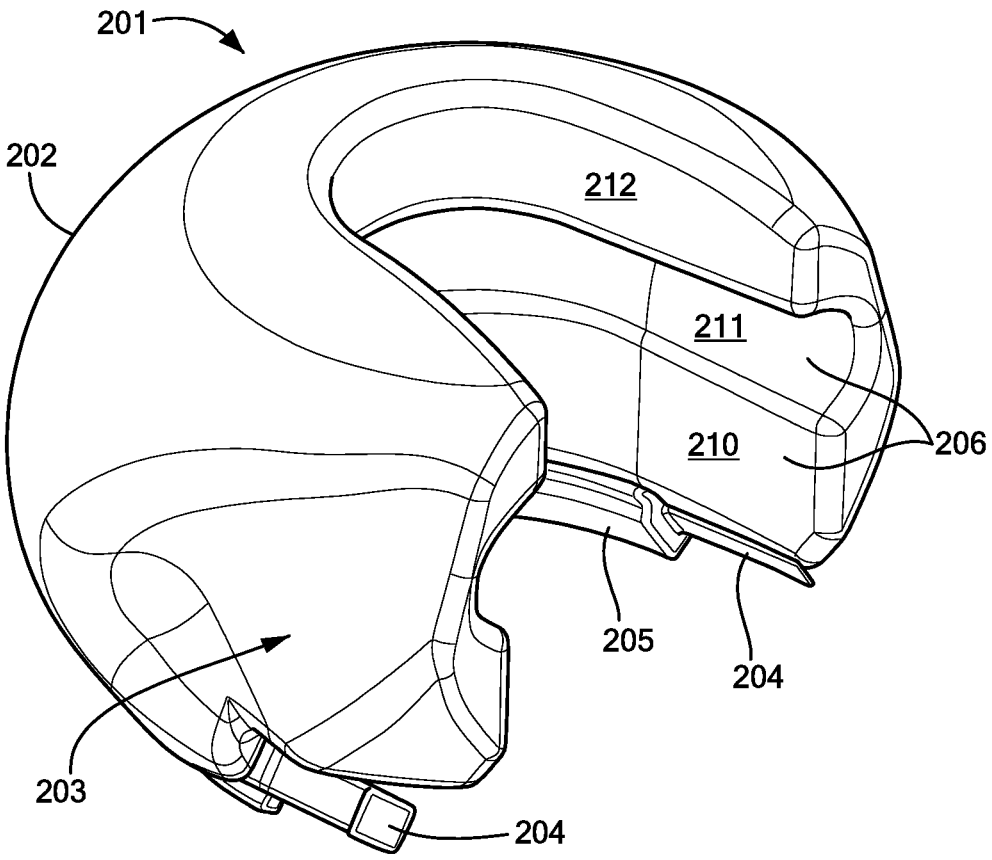
FIG. 2 shows a perspective view of an adaptor portion for connection to the power tool of FIG. 1 for reducing vibration transfer to a user.

FIG. 2 shows an example first portion 201 of an adaptor forming part of a vibration dampening system in accordance with example embodiments of the invention. The first portion 201 of the adaptor is configured for coupling to a power tool, such as the power tool 101 of FIG. 1, for reducing the amount of vibration transfer from the tool to the hands of the user while enabling the user to maintain a secure grip. The first portion 201 of the adaptor adapts between a preexisting structure of a power tool and the desired configuration of a user's hand. In embodiments, the first portion 201 of the adaptor may attach securely to the power tool. In some embodiments, the first portion 201 of the adaptor is removable and replaceable. In other embodiments, the first portion 201 of the adaptor is permanently attached to the power tool, such as by a suitable adhesive.

The first portion of the adaptor 201 comprises a user contact surface 202 having an optional thumb grip recess 203. In embodiments, a desired number of recesses (not shown) to receive fingers can be formed in the user contact surface. In the illustrated embodiment, first and second interlock mechanisms 204 are located at ends of the adaptor first portion 201. An interior surface of the first portion 201 is contoured to complement an outer surface of a power tool, such as the power tool 101 of FIG. 1. In embodiments, the interior surface of the first portion of the adaptor 201 includes a tool contact surface having a first tool contact surface 205 that may be relatively rigid and a second tool contact surface 206 that is relatively compliant.

The first tool contact surface 205 may be rigid and sized to abut a bottom of the annular body 105 of the power tool 101 above the vibrating surface 104 of the tool. The interlocks 204 enable the adaptor first portion 201 to be secured to the power tool 101. In embodiments, the interlocks 204 are configured for interference friction fit engagement to a body of a power tool. In other embodiments, the interlocks 204 comprise a belt with locks to remove slack in the belt.

In the illustrated embodiment, the second tool contact surface 206 includes a first portion 210 that is configured to abut the body 105 of the power tool 101 of FIG. 1 and a grooved second portion 211 that is configured to receive and envelop the disc-shaped tool grip surface 102. A third portion 212 of the second tool contact surface 206 extends above the grip surface 102 of the tool to provide a vibration-absorbing interface with the user's hand(s).

In illustrated embodiments, the outer surface of the adaptor first portion 201 is generally round and smooth. It is understood that the outer surface of the adaptor can comprise any practical geometry that is effective to reduce the transfer of vibration from the tool to the user's hands. The adaptor can comprise, for example, a mushroom shape and may include one or more finger slots for gripping the tool more easily. In embodiments, the adaptor is configured for single hand operation or multi-hand operation and may be user orientation agnostic. It is further understood that the shape of the power tool may define the characteristics of the adaptor. For example, a power tool having a shape with squared edges may require an adaptor with more of a square shape. In general, the thickness of the adaptor material may be relatively consistent to provide the desired vibration dampening effect while affording adequate control of the tool in use.

Figure 3:
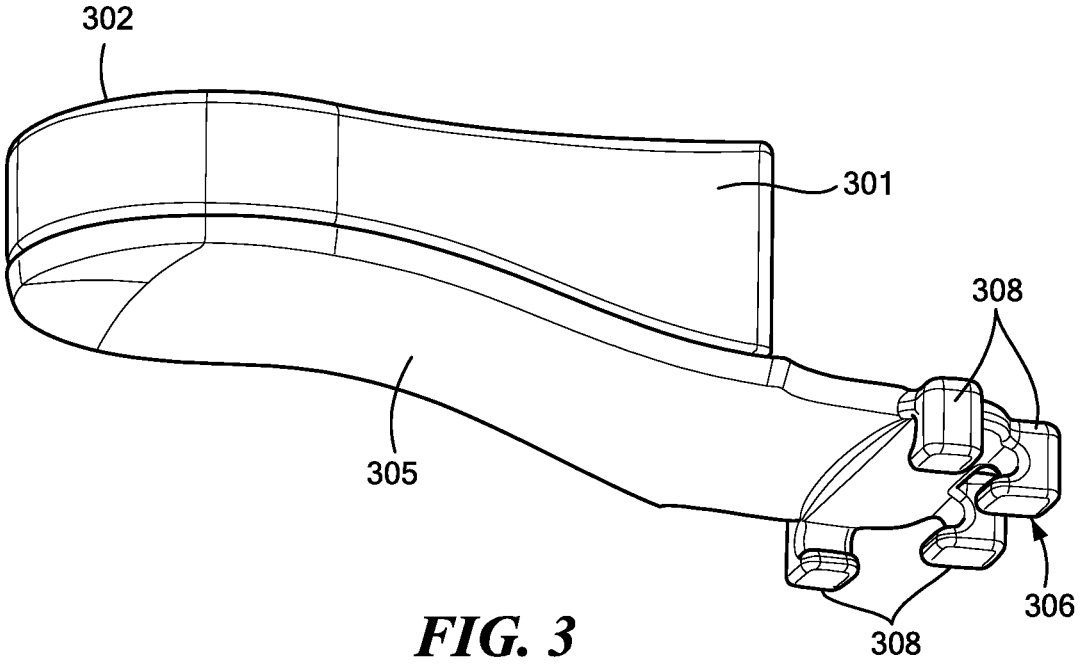
FIG. 3 shows a perspective view of another adaptor portion for connection to the power tool of FIG. 1 for reducing vibration transfer to a user.

FIG. 3 shows an example second portion 301 of an adaptor forming part of a vibration dampening system in accordance with example embodiments of the invention. The second portion 301 can include a user contact surface 302 and a tool contact surface 305. In embodiments, the user contact surface 302 is relatively compliant and the tool contact surface 305 is relatively rigid.

In embodiments, the second portion 301 of the adaptor includes a connection mechanism 306 to form a mechanical connection to a power tool, such as the power tool 101 of FIG. 1. The upper surface 103 of the power tool can include a lip or edge 108 that extends outwardly. In the illustrated embodiment, the connection mechanism 306 includes a series of grippers 308 that grab the lip 108 of the upper surface 103 of the power tool. As the second portion 301 of the adaptor is coupled to the tool, such as slid onto the tool, the lip 108 is captured by the grippers 308. The tool contact surface 305 then abuts the upper surface 103 of the tool.

In embodiments, the second portion 301 of the adaptor can be removably or permanently secured to the power tool. Mechanical interlocks may be used for removably engaging the adaptor to the tool. Adhesives, for example, may provide a permanent attachment of the adaptor to the tool.

In general, the second portion 301 of the adaptor may receive applied force from the user pressing the tool downward toward a surface to be sanded, for example. Some users may use the first portion 201 of the adaptor more for controlling a direction of the tool. In embodiments, the first and second portions 201, 301 of the adaptor may have different configurations to meet the needs of a particular tool or application. For example, the first or second portion of the adaptor may include more core material than the other in view of inherent tradeoffs between tool control, user feel, intended application, user protection, and the like.

It is understood that an adaptor can include one or both of the first and second portions 201, 301 of the adaptor and can include additional adaptor portions to meet the needs of a particular application. For example, some power tools may require multiple users for safe operation so that adaptor portions may be required for three or more contact surfaces.

Figure 4:
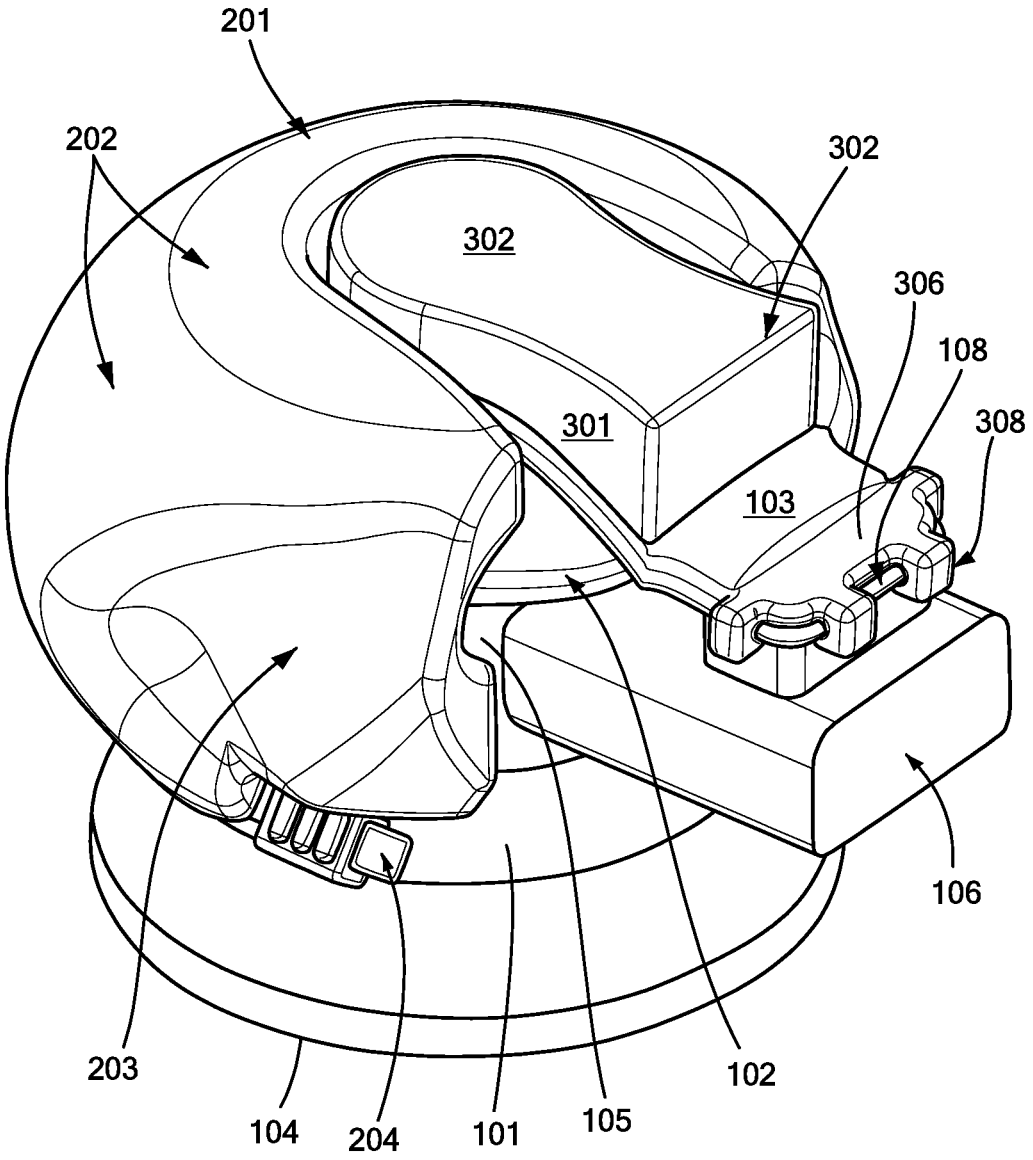
FIG. 4 shows a perspective view of the adaptor portions of FIGS. 2 and 3 connected to the power tool of FIG. 1 for reducing vibration transfer to a user.

FIG. 4 shows the first and second portions 201, 301 of the adaptor secured to a power tool, such as the power tool 101 of FIG. 1. In the illustrated embodiment, the first and second interlock mechanisms 204 of the adaptor first portion 201 are engaged with the annular body 105 of the tool and the grippers 308 of the adaptor second portion 301 capture the lip 108 of the grip surface 102 after the adaptor is coupled to the tool. A user can place one or both hands on the user contact surfaces 202, 302 of the first and second portions 201, 301 of the adaptor. The user can place a thumb in the depression 203 of the first portion 201 of the adaptor if desired. As can be seen, the second portion 301 of the adaptor is generally on top of the power tool 101 opposite the vibrating surface 104.

Figure 5A:
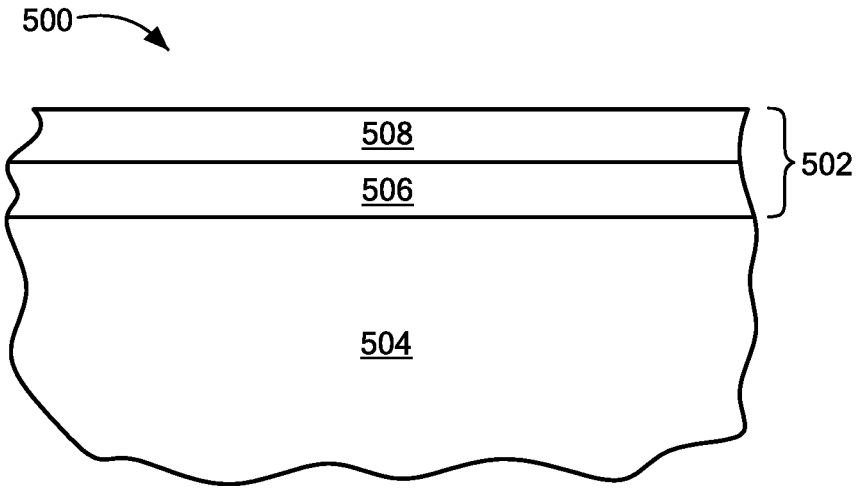
FIG. 5A shows a portion of a cross-section of an example user contact surface of an adaptor portion.
Figure 5B:
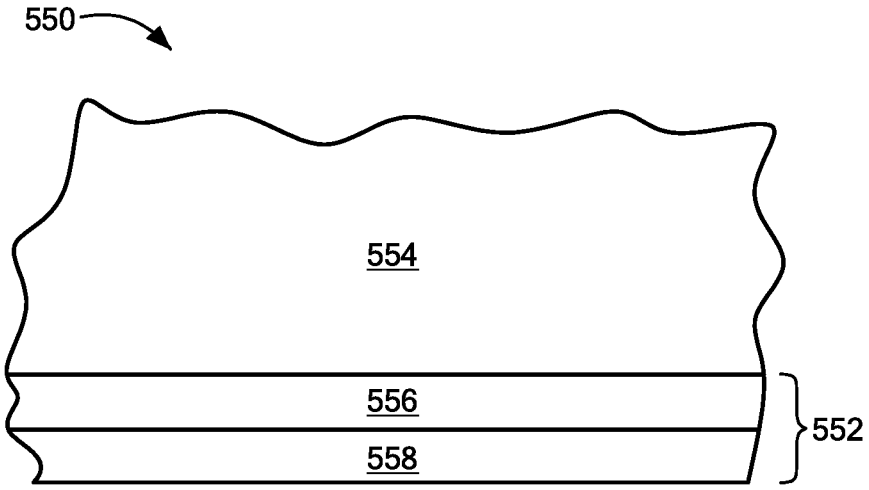
FIG. 5B shows a portion of a cross-section of an example tool contact surface of an adaptor portion.

FIG. 5A shows a portion 500 of a cross-section of an example user contact surface, such as the user contact surfaces 202, 302 of FIGS. 2 and 3, and FIG. 5B shows a portion 550 of a cross-section of a tool contact surface, such as the tool contact surfaces 206, 305 of the first and second portions 201, 301 of the adaptor. In some embodiments, the user contact surface 500 and the tool contact surface 550 are substantially similar and in other embodiments they are different.

FIG. 5A shows the first portion 500 of the adaptor, which may comprise the adaptor first portion 201 of FIG. 2, with a user contacting surface 502, which may comprise the user contacting surface 202 of FIG. 2. The first portion 500 includes a core 504 comprising a closed cell liquid filled foam (CCLFF). In embodiments, the core 504 comprises a first material including a viscoelastic polymer and a second material including a liquid, which may be dispersed into the first material, e.g., viscoelastic material. In one particular embodiment, the viscoelastic polymer comprises an ultraviolet (UV) cured acrylate and the liquid comprises polyethene glycol.

The CCLFF can have relative cell size, and density of cells, spatially varied throughout the section. In some embodiments, the CCLFF has a relatively consistent density. In other embodiments, a density of the CCLFF has a gradient due to more liquid at the center than at the boundary. In one particular embodiment, the cell size is in the order of 16 microns tall plus/minus ten percent, 40 microns wide plus/minus ten percent, and 80 microns long plus/minus ten percent.

In embodiments, a thickness of the core/CCLFF can vary to meet the needs of a particular application, tool, user, operational environment, etc. In embodiments, the core thickness can range from about 3 mm to about 5 cm. In general, greater core thicknesses provide greater protection for the user of the tool with a tradeoff between protection and control.

An example percentage of liquid by volume for vibration absorption is in the order of about 25%. In embodiments, the percentage of liquid by volume can vary from about 0% to about 50%. At about 1.0 Hz, a storage modulus for the core 504 can vary between about 0.2 Mpa and about 1.4 Mpa and the Loss modulus can be varied between about 0.1 Mpa and 1.4 Mpa by varying liquid concentrations.

In embodiments, the user contacting surface 502 comprises a sealing layer 506 around a portion or entirety of the core 504. The sealing layer 506 promotes bonding of materials to the core/CCLFF. In embodiments, the sealing layer 506 comprises a layer of 0% liquid around the entire CCLFF to prevent having liquid on the surface of the core/CCLFF that would prevent adhesion of materials to the core/CCLFF. In embodiments, the sealing layer 506 comprises about a 2*mm* thick layer of the same viscoelastic material from the CCLFF. The user contact surface 502 can include an optional surface layer 508 bonded to the adaptor to ruggedize the adaptor. The surface layer 508 can comprise a relatively durable rubberlike material, such as a synthetic rubber, e.g., polyurethane, castable rubbers, elastomers, and the like. By providing a user contacting surface 502 having a sealing layer 506 and/or a rubberlike layer 508, the user contacting surface 502 has a sealed durable surface that facilitates cleaning and dust removal and prevents the liquid from the foam from leaking onto the user's hands or work pieces. Example polymers include silicones and urethanes, and example liquids include mineral oil, liquid silicone, and the like. In some embodiments, electromagnetic materials can be used, such as magnetoresistive materials in order to meet the needs of a particular application.

The user contacting surface 502 and entirety of the first portion 500 of the adaptor should be shaped to promote a controlled grip while providing sufficient CCLFF between the human hand and the power tool to minimize vibration transfer. As a result, there is a tradeoff between grip quality and protection.

In some embodiments, the adaptor is custom produced to the use case, user and tool, such as by 3D printing. In order to promote grip, the surface of human contact can have finger groves or thumb depressions to encourage finger placement and enhance grip. The surface of human contact can be produced in batches such as large medium and small to group users together based on hand size.

FIG. 5B shows a portion 550 of an example tool contacting surface 552 of the adaptor. The tool contacting surface 552 is the surface where the adaptor section meets the power tool. In embodiments, the portion 550 comprises a core 554 that may comprise a CCLFF. The core 554 may be similar to the core 504 described above for portion 500 of FIG. 5A. The tool contacting surface 552 may include a sealing layer 556 to seal the CCLFF, as described above. In some embodiments, the first portion 550 includes the core 554 with or without additional compliant coatings. In embodiments, the tool contact surface 552 includes an optional rigid layer 558 that may comprise piece of plastic or metal bonded to the CCLFF and other layers. It should be surface fitting to the power tool and allow the adaptor section to slide onto the power tool. The goal of the tool contact surface is to reduce the number of degrees of freedom of the adaptor section relative to a part of the power tool to one or less. One degree allows for sliding on and off of the tool.

In embodiments, the connection between the adaptor section(s) 201, 301 and the power tool 101 can comprise chemical bonds and/or mechanical connections. Chemical bonds are designed to be permanent or semi-permanent by adding a compound, such as an adhesive, between one or more of the tool contact surfaces 205, 206, 305 and the power tool surface to chemically link the surfaces. Example adhesive compounds can comprise a liquid, such as cyanoacrylates, epoxies, and silicones. In embodiments, tape having double-sided adhesive can be used. In semi-permanent connections, the chemical bond can be broken mechanically or chemically without damaging the underlying power tool.

Example mechanical connections between the adaptor sections and the tool include friction/interference fit, where the geometry of the inner surface of the adaptor section generates high friction forces between the adaptor section and the power tool. In embodiments, the mechanical connection is configured to eliminate all but one degree of freedom of the adaptor section relative to a part of the power tool. Friction between the adaptor section and the power tool eliminates other degrees of freedom.

In embodiments, a variety of suitable interlocks, clips, buckles, snaps, and the like can adequately constrain movement of the adaptor section relative to the tool to one degree or less so that the adaptor section can only move in one or fewer directions relative to the power tool.

Figure 6:
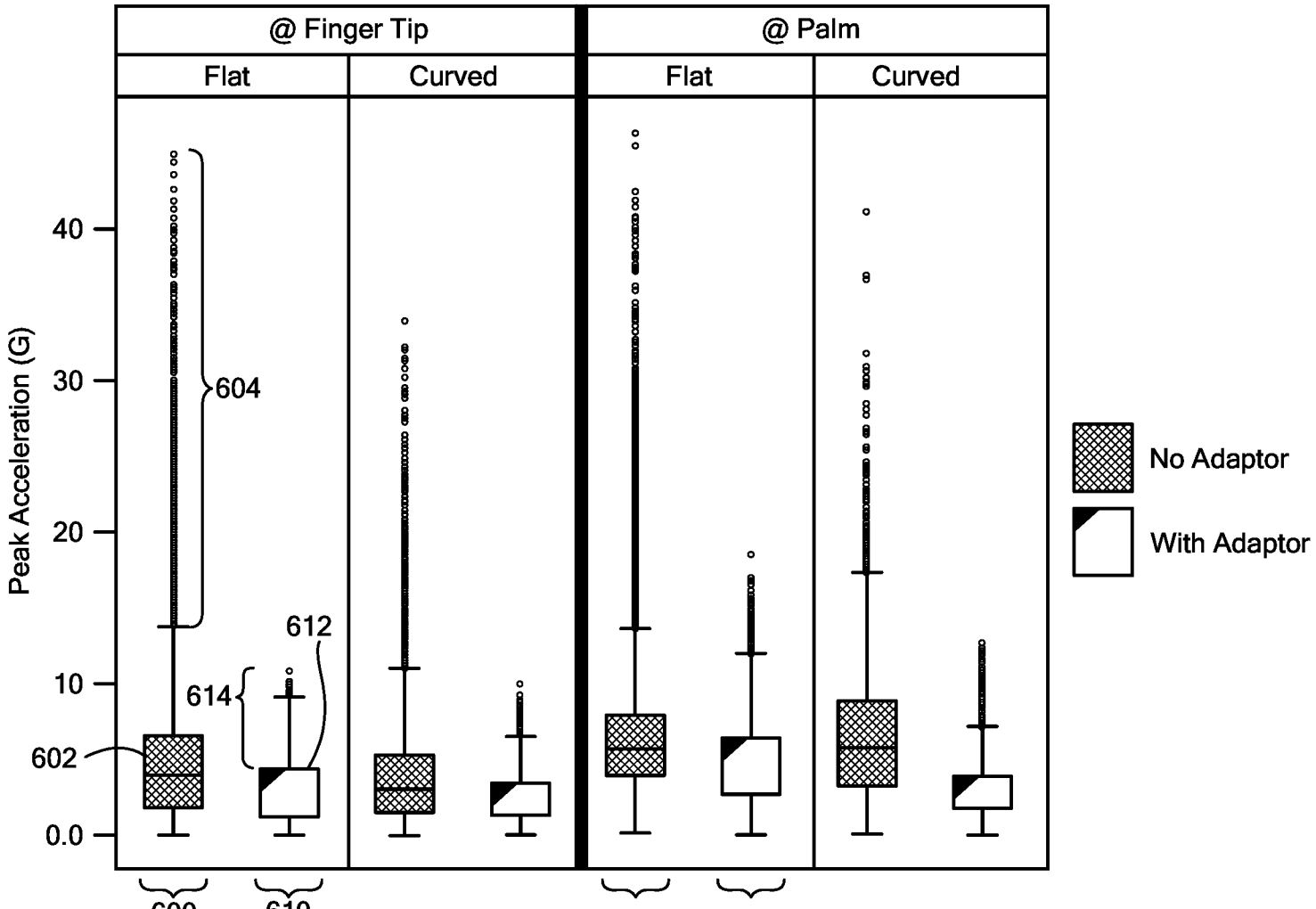
FIG. 6 shows example graphical data for peak acceleration transferred to the hands of a user of a power tool with and without an example adaptor embodiment attached to the tool.

FIG. 6 shows example graphical data for peak acceleration transferred to the hands of a user of a power tool with and without an example adaptor embodiment. As can be seen, peak acceleration data 600 received at user fingertips for a power tool sanding a flat surface without an adaptor is greater than acceleration data 610 with an adaptor. The acceleration data 600 without an adaptor includes normalized data 602 with a given distribution and peaks 604 outside the normal distribution. The acceleration data 610 also includes normalized data 612 and peaks 614 outside the normalized data. It can be readily seen that the user experiences significantly reduced acceleration data with the adaptor on the tool including less energy on a normalized basis and less energy from acceleration peaks. It is understood that acceleration peaks 604 can be especially damaging to a user's hands. Similar data is shown for sanding a curved surface and for a user's palm.

Figure 7:
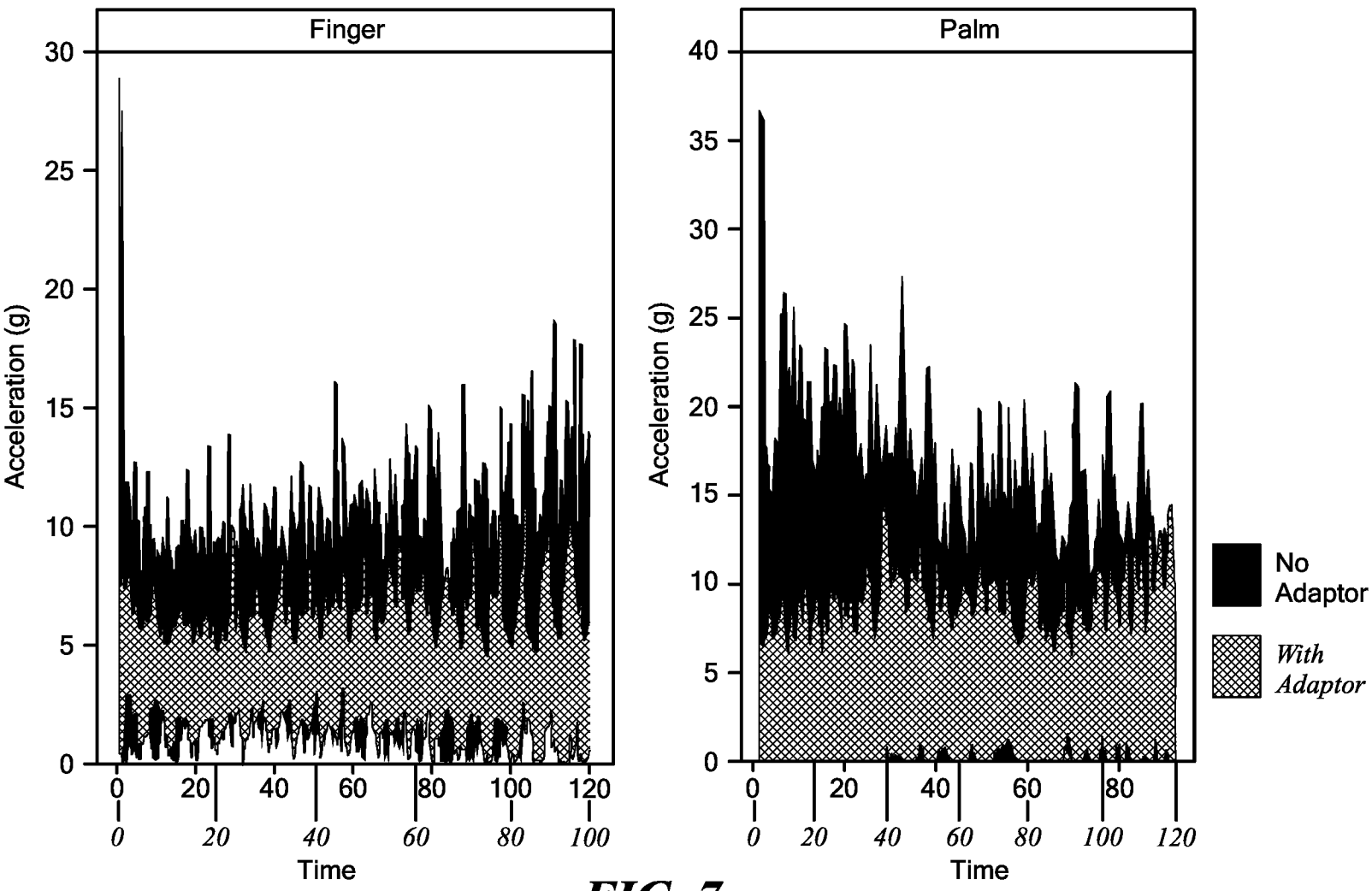
FIG. 7 shows example graphical data for g-force acceleration transferred to the hands of a user of a power tool with and without an example adaptor embodiment attached to the tool.

FIG. 7 shows g-force acceleration for a user of a power tool without and with an adaptor over some period of time. As can be seen, the acceleration received at the hands of a user is reduced by use of an adaptor by an order of magnitude.

Figure 8:
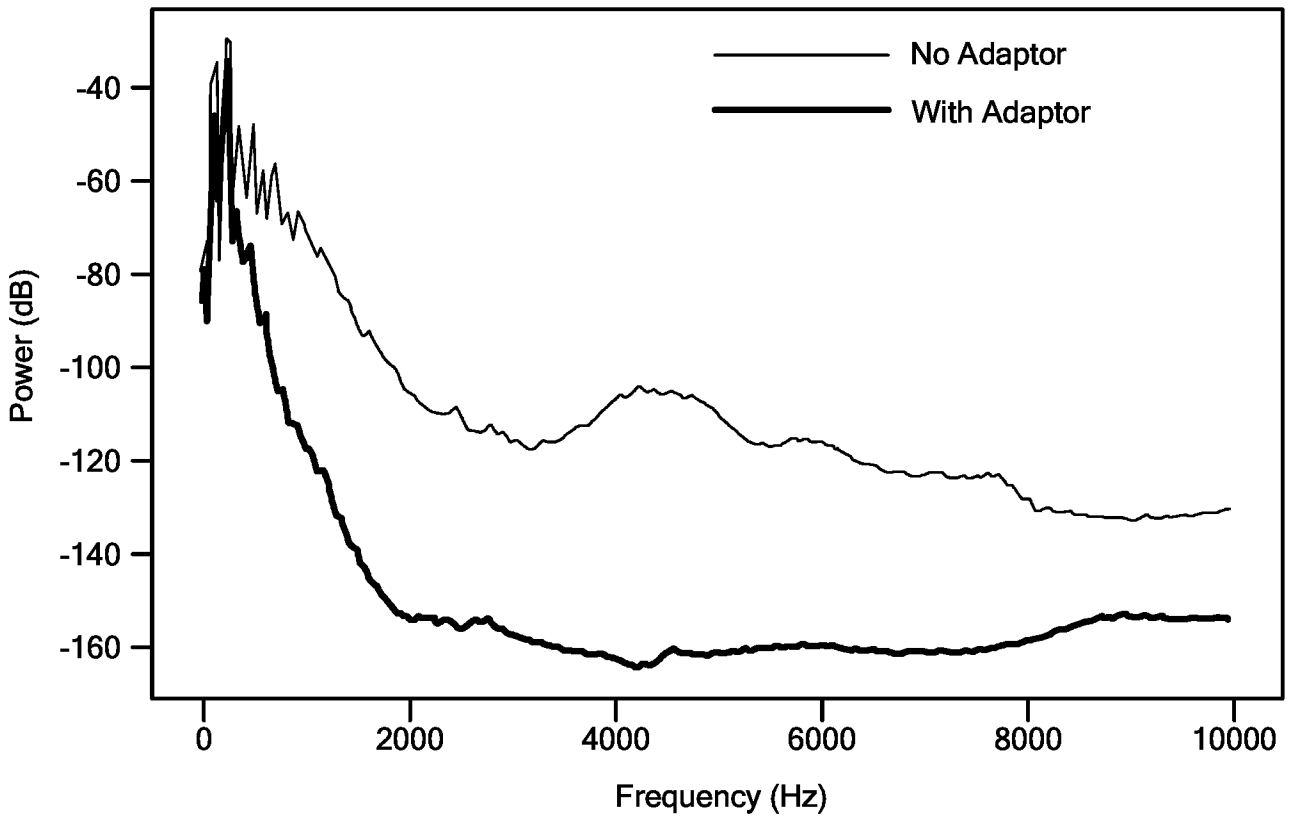
FIG. 8 shows example graphical data for power in dB transferred to a user's hands over frequency by a power tool with and without an adaptor.

FIG. 8 shows power in dB transferred to a user's hands over frequency by a power tool with and without an adaptor. As can be seen, the acceleration received at the hands of a user is reduced significantly by use of an adaptor.

Various embodiments of the concepts systems and techniques are described herein with reference to the related drawings. Alternative embodiments can be devised without departing from the scope of the described concepts. It is noted that various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. As an example of an indirect positional relationship, references in the present description to element or structure "A" over element or structure "B" include situations in which one or more intermediate elements or structures (e.g., element "C") is between element "A" and element "B" regardless of whether the characteristics and functionalities of element "A" and element "B" are substantially changed by the intermediate element(s).

The following definitions and abbreviations are to be used for the interpretation of the claims and the specification.

As used herein, the terms "comprises," "comprising," "includes," "including," "has," "having," "contains" or "containing," or any other variation thereof, are intended to cover a non-exclusive inclusion. For example, a method, article, or apparatus that comprises a list of elements is not necessarily limited to only those elements but can include other elements not expressly listed or inherent to such method, article, or apparatus.

Additionally, the term "exemplary" is used herein to mean "serving as an example, instance, or illustration." Any embodiment or design described herein as "exemplary" is not necessarily to be construed as preferred or advantageous over other embodiments or designs. The terms "one or more" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection".

References in the specification to "one embodiment," "an embodiment," "an example embodiment," or variants of such phrases indicate that the embodiment described can include a particular feature, structure, or characteristic, but every embodiment can include the particular feature, structure, or characteristic. Moreover, such phrases are not necessarily referring to the same embodiment. Further, when a particular feature, structure, or characteristic is described in connection knowledge of one skilled in the art to affect such feature, structure, or characteristic in connection with other embodiments whether or not explicitly described.

Furthermore, it should be appreciated that relative, directional or reference terms (e.g. such as "above," "below," "left," "right," "top," "bottom," "vertical," "horizontal," "front," "back," "rearward," "forward," etc.) and derivatives thereof are used only to promote clarity in the description of the figures. Such terms are not intended as, and should not be construed as, limiting. Such terms may simply be used to facilitate discussion of the drawings and may be used, where applicable, to promote clarity of description when dealing with relative relationships, particularly with respect to the illustrated embodiments. Such terms are not, however, intended to imply absolute relationships, positions, and/or orientations. For example, with respect to an object or structure, an "upper" surface can become a "lower" surface simply by turning the object over. Nevertheless, it is still the same surface and the object remains the same. Also, as used herein, "and/or" means "and" or "or", as well as "and" and "or." Moreover, all patent and non-patent literature cited herein is hereby incorporated by references in their entirety.

The terms "disposed over," "overlying," "atop," "on top," "positioned on" or "positioned atop" mean that a first element, such as a first structure, is present on a second element, such as a second structure, where intervening elements or structures (such as an interface structure) may or may not be present between the first element and the second element. The term "direct contact" means that a first element, such as a first structure, and a second element, such as a second structure, are connected without any intermediary elements or structures between the interface of the two elements.

Having described exemplary embodiments, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

Elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

What is claimed is:

1. An adaptor configured for coupling to a power tool for reducing transmission of vibrations from the power tool to hands of a user while allowing maintenance of a grip by the user, the adaptor comprising:

one or more adaptor sections, each adaptor section comprising:

a core comprising a closed cell liquid filled foam (CCLFF);

a user contact surface configured for contact by a user;

a tool contact surface configured for contact with the power tool, wherein the core is disposed between the user contact surface and the tool contact surface; and a connection mechanism configured to secure the adaptor to the power tool.

2. The adaptor according to claim 1, wherein the at least one of the one or more adaptor sections comprises an inner surface contoured to complement a portion of an outer surface of the power tool.

3. The adaptor according to claim 1, wherein at least one of the one or more adaptor sections comprises a depression for receiving one or more digits of a human hand.

4. The adaptor according to claim 3, wherein the depression is configured to receive a human thumb.

5. The adaptor according to claim 1, wherein the power tool comprises a sander having a vibrating surface.

6. The adaptor according to claim 1, wherein the CCLFF comprises a viscoelastic polymer and a liquid.

7. The adaptor according to claim 6, wherein the CCLFF comprises a percentage of the liquid by volume that ranges from about 0 percent to 50 percent.

8. The adaptor according to claim 7, wherein the percentage of the liquid by volume is 25 percent.

9. The adaptor according to claim 6, wherein the viscoelastic polymer comprises an acrylate.

10. The adaptor according to claim 9, wherein the acrylate is ultraviolet (UV) light cured.

11. The adaptor according to claim 6, wherein the liquid comprises polyethylene glycol.

12. The adaptor according to claim 1, wherein the CCLFF comprises a cell size of about sixteen microns tall, plus or minus 10 percent.

13. The adaptor according to claim 12, wherein the cell size is 40 microns wide, plus or minus 10 percent.

14. The adaptor according to claim 13, wherein the cell size is 80 microns long, plus or minus 10 percent.

15. The adaptor according to claim 1, wherein the CCLFF has a storage modulus that can range from about 0.2 Mpa to 1.4 Mpa at a frequency of about 1 Hz.

16. The adaptor according to claim 1, wherein the CCLFF has a loss modulus that can vary from 0.1 Mpa to 1.4 Mpa.

17. The adaptor according to claim 1, wherein the CCLFF is at least partially coated with a sealing layer comprising a zero percent liquid layer.

18. The adaptor according to claim 17, wherein the CCLFF comprises a viscoelastic polymer and a liquid, and the sealing layer comprises the viscoelastic polymer.

19. The adaptor according to claim 17, further including a synthetic rubber layer bonded to the sealing layer.

20. The adaptor according to claim 1, wherein the tool contact surface comprises a rigid material.

21. The adaptor according to claim 20, wherein the rigid material comprises a plastic or a metal or a combination of a plastic and a metal.

22. The adaptor according to claim 1, wherein the at least one of the one or more adaptor sections comprises an inner surface configured for friction fit engagement to an outer surface of the power tool.

23. The adaptor according to claim 1, wherein the CCLFF is at least partially coated with a sealing layer, wherein the sealing layer either comprises one of:

a viscoelastic polymer, or a zero percent liquid layer, or the sealing layer is bonded to a synthetic rubber layer.

* * * * *